US008369063B2

(12) United States Patent
Vicente

(10) Patent No.: US 8,369,063 B2
(45) Date of Patent: Feb. 5, 2013

(54) ELECTRONIC SELECTOR SWITCH FOR PERFORATION

(75) Inventor: Jose German Vicente, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 323 days.

(21) Appl. No.: 12/774,950

(22) Filed: May 6, 2010

(65) Prior Publication Data

US 2011/0271823 A1 Nov. 10, 2011

(51) Int. Cl.
*F23Q 7/00* (2006.01)

(52) U.S. Cl. ..... 361/250

(58) Field of Classification Search ..... 361/250
See application file for complete search history.

(56) References Cited

U.S. PATENT DOCUMENTS

| | | | | |
|---|---|---|---|---|
| 4,007,796 | A | | 2/1977 | Boop |
| 4,208,966 | A | | 6/1980 | Hart |
| 4,234,767 | A | | 11/1980 | Davis et al. |
| 4,454,841 | A | | 6/1984 | Reinhard et al. |
| 4,457,383 | A | | 7/1984 | Boop |
| 4,496,010 | A | | 1/1985 | Chapman et al. |
| 4,527,636 | A | | 7/1985 | Bordon |
| 4,778,009 | A | | 10/1988 | Sumner et al. |
| 4,991,684 | A | | 2/1991 | Mitchell |
| 5,042,594 | A | * | 8/1991 | Gonzalez et al. ..... 175/4.55 |
| 5,505,134 | A | * | 4/1996 | Brooks et al. ..... 102/202.7 |
| 5,531,164 | A | | 7/1996 | Mosley |
| 5,700,969 | A | | 12/1997 | Mosley |
| 7,066,261 | B2 | | 6/2006 | Vicente et al. |
| 7,387,162 | B2 | * | 6/2008 | Mooney et al. ..... 166/297 |
| 7,565,927 | B2 | * | 7/2009 | Gerez et al. ..... 166/250.01 |
| 2010/0051440 | A1 | | 3/2010 | Hurst |

* cited by examiner

*Primary Examiner* — Stephen W Jackson
(74) *Attorney, Agent, or Firm* — Howard L. Speight

(57) ABSTRACT

A circuit includes a line input for receiving a line power. The circuit further includes a line output for transmitting the line power. The circuit further includes a next-gun-detect output and a next-gun-detect input. The circuit further includes a first detonator connection and a second detonator connection, the second detonator connection being connected to a ground. The line input is coupled to the first detonator connection through a one-polarity-pass component that only allows power of a first polarity to pass. The line input is coupled to the first detonator connection through a detonate-enable switch circuit that is coupled to the next-gun-detect output and the line input. The detonate-enable switch passes power only if (a) the next-gun-detect output is not coupled to the next-gun-detect input and (b) power of a second polarity has previously been applied to the line input while the next-gun-detect output is not coupled to the next-gun-detect input.

19 Claims, 12 Drawing Sheets

ELECTRONIC SELECTOR SWITCH FOR PERFORATION

BACKGROUND

An oil well typically goes through a "completion" process after it is drilled. Casing is installed in the well bore and cement is poured around the casing. This process stabilizes the well bore and keeps it from collapsing. Part of the completion process involves perforating the casing and cement so that fluids in the formations can flow through the cement and casing and be brought to the surface. The perforation process is often accomplished with shaped explosive charges. These perforation charges are often fired by applying a voltage to the charges.

DETAILED DESCRIPTION

Figure 1:
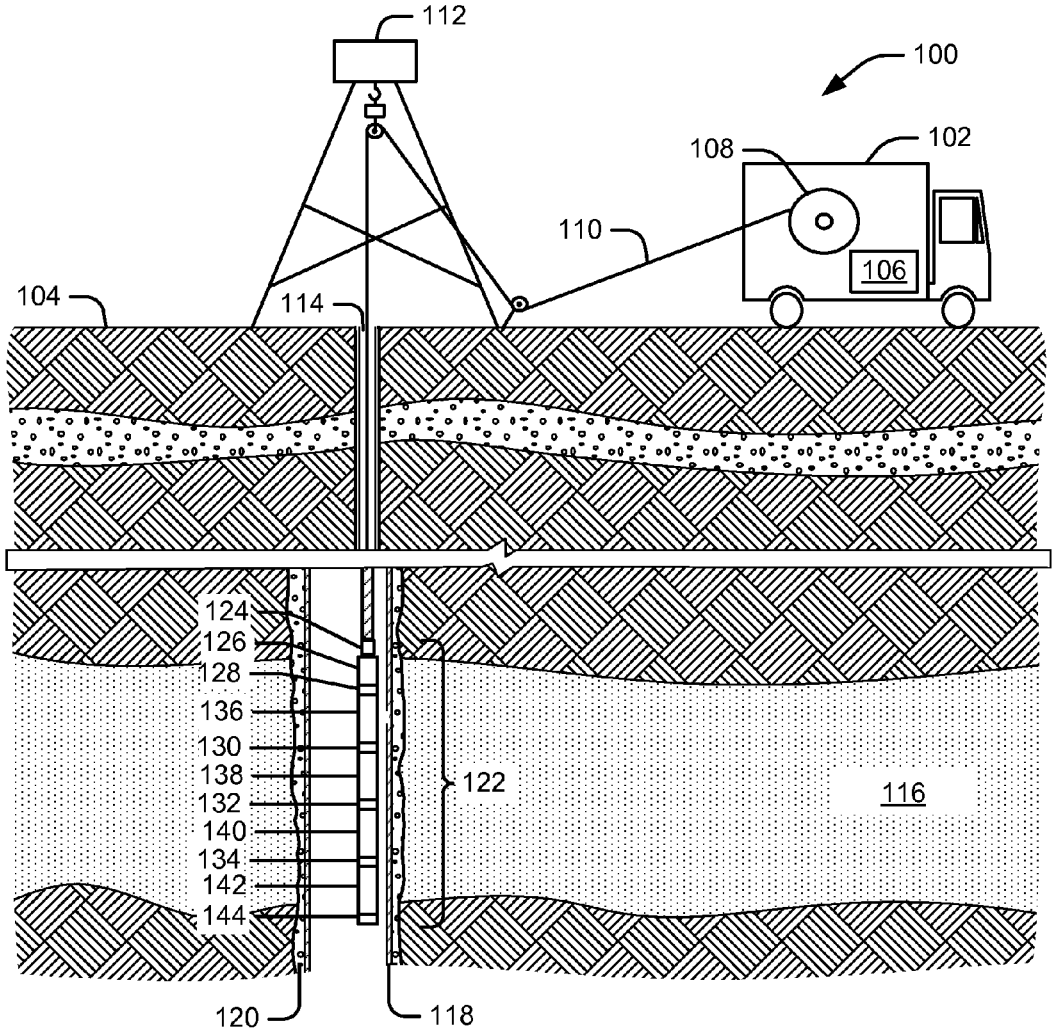
FIG. 1 illustrates a perforation system.

In one embodiment of a perforation system 100 at a drilling site, as depicted in FIG. 1, a logging truck or skid 102 on the earth's surface 104 houses a shooting panel 106 and a winch 108 from which a cable 110 extends through a derrick 112 into a well bore 114 drilled into a hydrocarbon-producing formation 116. In one embodiment, the derrick 112 is replaced by a truck with a crane (not shown). The well bore is lined with casing 118 and cement 120. The cable 110 suspends a perforation apparatus 122 within the well bore 114.

Figure 2:
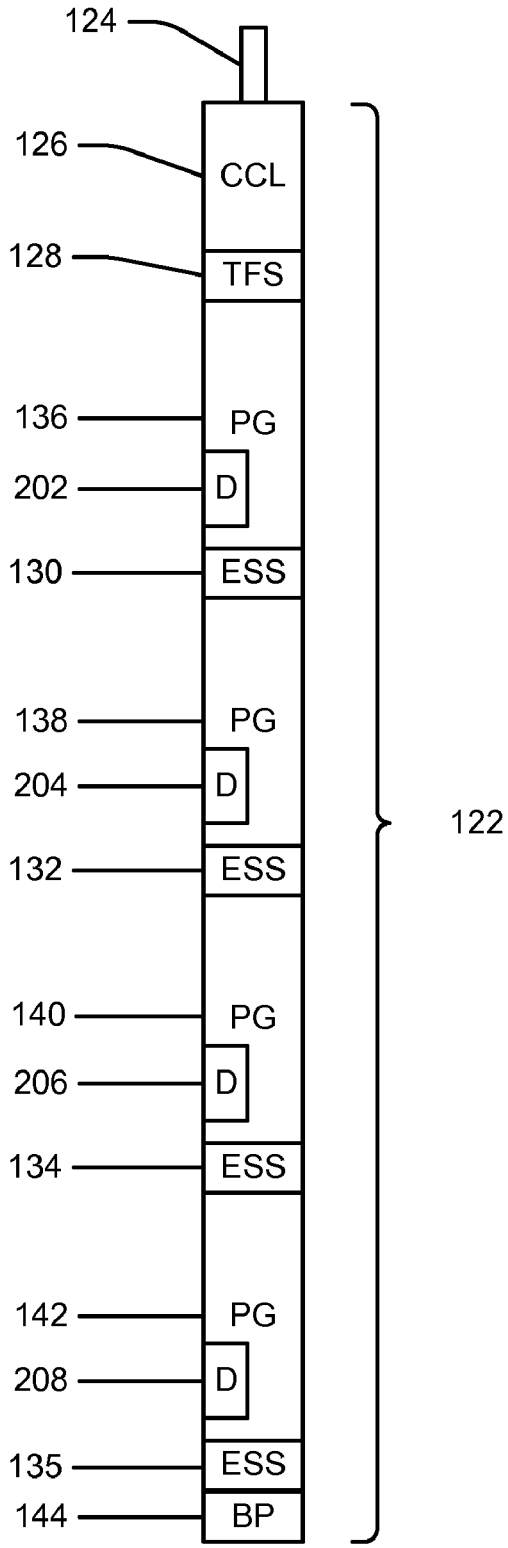
FIG. 2 illustrates a perforation apparatus.

In one embodiment shown in FIGS. 1 and 2, the perforation apparatus 122 includes a cable head/rope socket 124 to which the cable 110 is coupled. In one embodiment, an apparatus to facilitate fishing the perforation apparatus (not shown) is included above the cable head/rope socket 124. In one embodiment, the perforation apparatus 122 includes a casing collar locator ("CCL") 126, which facilitates the use of magnetic fields to locate the thicker metal in the casing collars (not shown). The information collected by the CCL can be used to locate the perforation apparatus 122 in the well bore 114.

In one embodiment, the perforation apparatus 122 includes a top fire sub ("TFS") 128 that provides an electrical and control interface between the shooting panel 106 on the surface and the rest of the equipment in the perforation apparatus 122. In one embodiment, the TFS 128 is not necessary and the shooting panel directly controls the perforation apparatus 122.

In one embodiment, as shown in FIG. 2, the perforation apparatus 122 includes a plurality of electronic selector switches ("ESS") 130, 132, 134, 135 and a plurality of perforation charge elements (or perforating gun or "PG") 136, 138, 140, and 142 that include detonators ("D") 202, 204, 206, 208. In one embodiment, the electronic sector switches are packaged in the same housing as the perforation charge elements. That is, in one embodiment, the housing for perforation charge element 136 also houses electronic selector switch 130 and detonator 202. Similarly, in one embodiment, the housing for perforation charge element 138 houses electronic selector switch 132 and detonator 204, the housing for perforation charge element 140 houses electronic selector switch 134 and detonator 206, and the housing for perforation charge element 142 houses electronic selector switch 135 and detonator 208.

The perforation charge elements 136, 138, 140, and 142 are described in more detail in the discussion of FIGS. 4-12. It will be understood by persons of ordinary skill in the art that the number of electronic selector switches and perforation charge elements shown in FIGS. 1-4 is merely illustrative and is not a limitation. Any number of electronic selector switches and sets of perforation charge elements can be included in the perforation apparatus 122.

In one embodiment, the perforation apparatus 122 includes a bull plug ("BP") 144 that facilitates the downward motion of the perforation apparatus 122 in the well bore 114. In one embodiment, the perforation apparatus 122 includes magnetic decentralizers (not shown) that are magnetically drawn to the casing causing the perforation apparatus to draw close to the casing as shown in FIG. 1.

Figure 3:
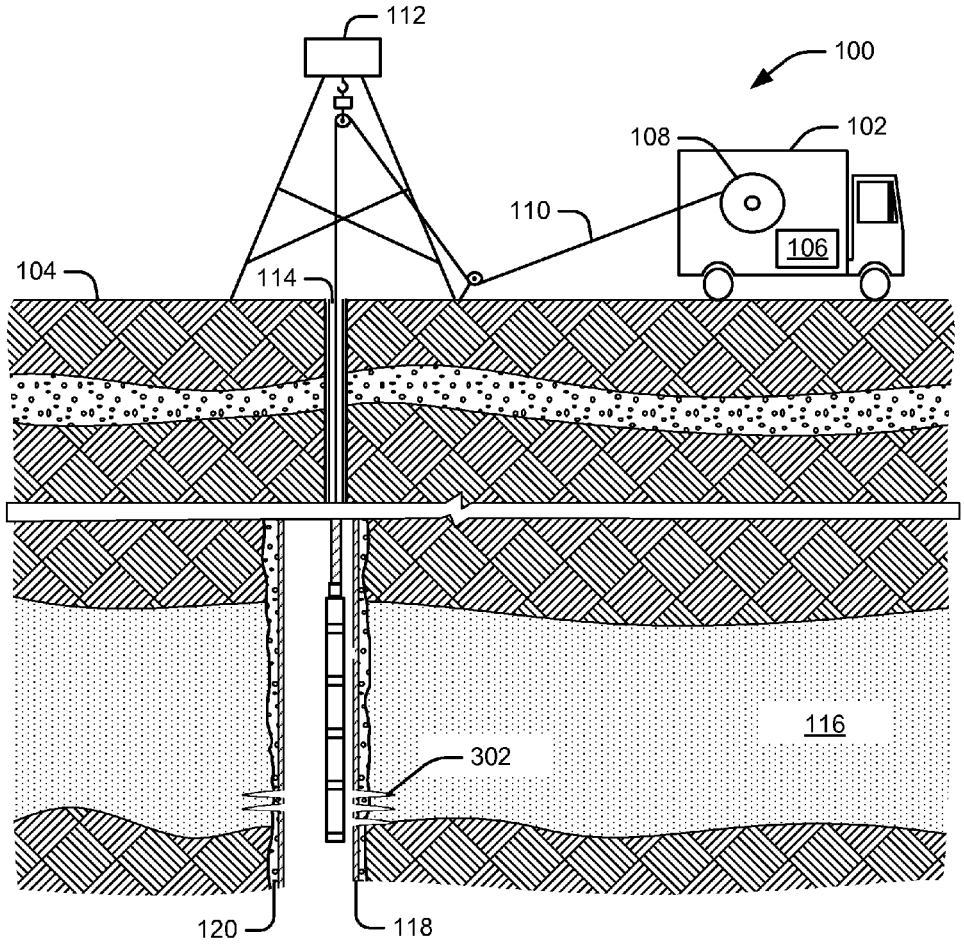
FIG. 3 illustrates the perforation system after one of the perforation charges has been fired.

FIG. 3 shows the result of the explosion of the lowest perforation charge element. Passages 302 (only one is labeled) have been created from the formation 116 through the concrete 120 and the casing 118. As a result, fluids can flow out of the formation 116 to the surface 104.

Figure 4:
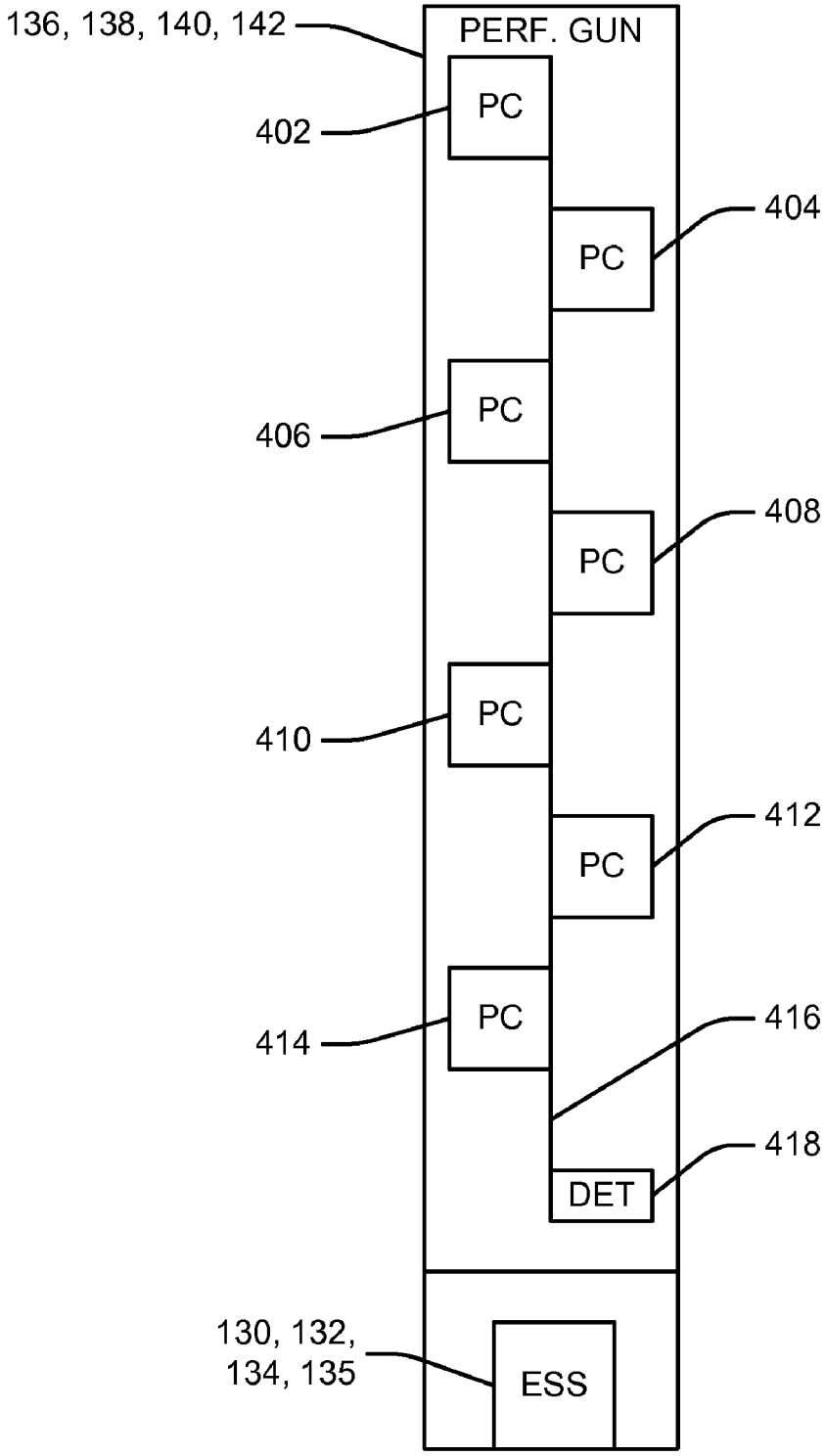
FIG. 4 is a mechanical block diagram of a perforation apparatus.

One embodiment of a perforation charge element (or "gun") 136, 138, 140, 142, illustrated in FIG. 4, includes 6 perforating charges ("PC") 402, 404, 406, 408, 410, 412, and 414. It will be understood that by a person of ordinary skill in the art that each perforation charge element 136, 138, 140, 142 can include any number of perforating charges.

In one embodiment, the perforating charges are linked together by a detonating cord 416 which is attached to a detonator 418. In one embodiment, when the detonator 418 is detonated, the detonating cord 416 links the explosive event to all the perforating charges 402, 404, 406, 408, 410, 412, 414, detonating them substantially simultaneously. In one embodiment, an electronic selector switch 130, 132, 134, 135 is attached to the lower portion of the perforating charge element 136, 138, 140, 142. In one embodiment, the electronic selector switches 130, 132, 134, 135 control the detonations of the perforating charge elements 136, 138, 140, 142. Thus in one embodiment, referring to FIG. 2, electronic selector switch 130 fires perforating charge element 136, electronic selector switch 132 fires perforating charge element 138, electronic selector switch 134 fires perforating charge element 140, and electronic selector switch 134 fires perforating charge element 140.

The electronic selector switches enable an operator to fire multiple guns downhole in succession without the use of mechanical switches activated by the detonation of a gun and without requiring alternating power polarities from the shooting panel to fire successive guns. That is, in one embodiment of the apparatus described herein, one power polarity arms each gun in succession and the same opposite polarity fires each gun in succession. In addition, in one embodiment if a limited constant current is applied to a set of guns, the number of guns left unfired can be determined from the voltage drop across the guns. Further, in one embodiment, the firing of a gun can be detected by monitoring the voltage drop across the guns, which drops by a predictable amount when a gun is fired.

Figure 5:
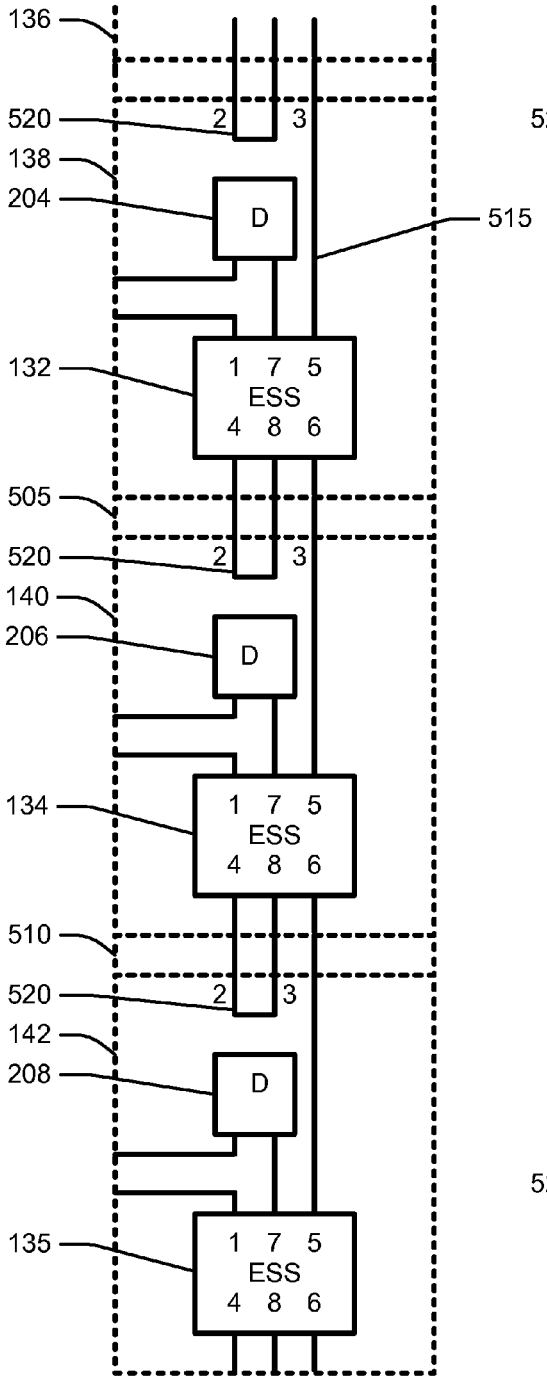
FIGS. 5-7 are electrical block diagrams of perforation apparatus embodiments.

One embodiment of such a system is illustrated in FIG. 5, which shows perforation charge element 138, which includes electronic selector switch 132 and detonator 204, perforation charge element 140, which includes electronic selector switch 134 and detonator 206, and perforation charge element 142, which includes electronic selector switch 132 and detonator 204, in a string of such perforation charge elements.

In one embodiment, each perforation charge element includes connections 1-8, which may be the numbers of pins on connectors that link the perforation charge elements, or the numbers of pins on electronic circuit boards or electronic circuit package, or a combination of those types of connections. The connection numbers correspond to the connector numbers (J1-J8) shown on FIGS. 5-12.

In one embodiment, the perforation charge elements are joined by a mechanical coupling, which, in addition to providing a mechanical linkage also allow electrical and electronic signals to pass from one perforation charge element to another. For example, in one embodiment, perforation charge element 138 is joined to perforation charge element 140 by mechanical coupling 505 and perforation charge element 140 is joined to perforation charge element 142 by mechanical coupling 510.

In one embodiment, each detonator has two connections. In one embodiment, one detonator connection is connected to a ground, such as the perforation charge element housing. In one embodiment, the other detonator connection is connected to connector 7 on the electronic selector switch.

In one embodiment, each electronic selector switch has six connections. In one embodiment, connection 7 is connected to one of the detonator connections as described above. In one embodiment, connection 1 of the electronic selector switch is connected to a ground, such as the perforation charge element housing. Thus, in one embodiment, a positive voltage imposed from the shooting panel, all the way down to connections 5 and 1 of the electronic selector switch will be applied across the detonator and, if the power is sufficient, the detonator will explode causing the associated perforating charge (i.e., such as perforating charges 402, 404, 406, 408, 410, 412, 414, and 418) to fire.

In one embodiment, connection 5 of the electronic selector switch is a line input connected to a connection 6 (or line output) of the preceding electronic selector switch. That is, in one embodiment connection 5 of the electronic selector switch 132 is connected to a line 515 which is controlled by the shooting panel 106 illustrated in FIG. 1. The line 515 connection between the electronic selector switch 132 and the shooting panel may be indirect, i.e., it may be switched by (or otherwise conditioned by) a number of other electronic selector switches or a top fire sub 128 between the shooting panel and the electronic selector switch 132, or the connection may be direct, with the shooting panel 106 being directly connected to the electronic selector switch 132.

In one embodiment, the line output (connection 6) of electronic selector switch 132 is connected to the line input (connection 5) of the electronic selector switch 134. In one embodiment, the line output (connection 6) of electronic selector switch 134 is connected to the line input (connection 5) of the electronic selector switch 135.

In one embodiment, the line output (connection 6) of the electronic selector switch 135 is not connected to anything. Similarly, connection 4 (or "next-gun-detect output") and connection 8 (or "next-gun-detect input") of the electronic selector switch 135 are not connected to anything. This is characteristic of the bottom-most gun in the string of guns. The term "bottom-most" refers to the un-fired gun that is the greatest distance electrically from the shooting panel 106. In one embodiment, the bottom-most gun will be the next gun fired in the sequence.

In one embodiment, connections 4 and 8 of electronic selector switch 132 are connected to connections 2 and 3 of perforation charge element 140. In one embodiment, connections 2 and 3 of perforation charge element 140 are shorted together which shorts together connections 4 and 8 of electronic selector switch 132. In one embodiment, connections 2 and 3 of perforation charge element 140 are shorted together by a shorting element 520. In one embodiment, the shorting element 520 is a loop of wire. In one embodiment, the shorting element 520 is positioned so that it ceases to short connections 2 and 3 of perforation charge element 140 when the perforating charges in perforating charge element 140 fire. For example, in one embodiment, the shorting element 520 is a loop of wire that is place near a perforating charge, or in one embodiment, is wrapped around a perforating charge, such that when the perforating charge fires, the wire is destroyed.

Figure 6:
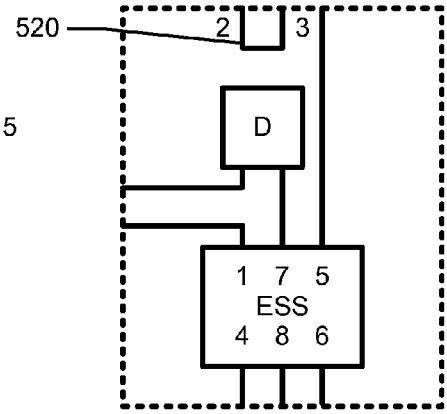

In one embodiment, shown in FIG. 6, a perforating charge element includes the shorting element 520 for one of the perforating charge element to which it is connected. For example, referring to FIG. 5, perforating charge element 138 contains the shorting element 520 for perforating charge element 136, perforating charge element 140 contains the shorting element 520 for perforating charge element 138, and perforating charge element 142 contains the shorting element 520 for perforating charge element 140.

Figure 7:
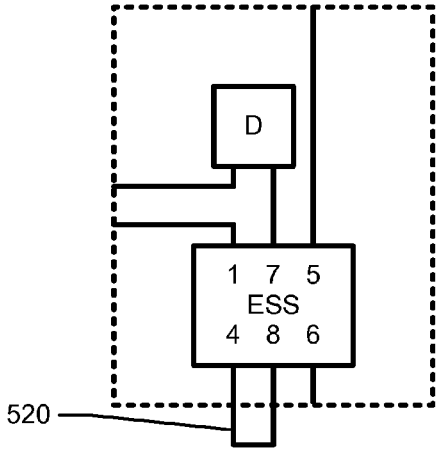

In one embodiment, shown in FIG. 7, a perforating charge element includes its own shorting element. In that case, as part of putting together the perforation apparatus 122, personnel would extend the shorting element 520 from the perforating charge element, e.g. 138, into (or around, etc.) the connected perforating charge element, e.g. 140, in such a way that firing the connected perforating charge element would destroy the shorting element 520.

Figure 8:
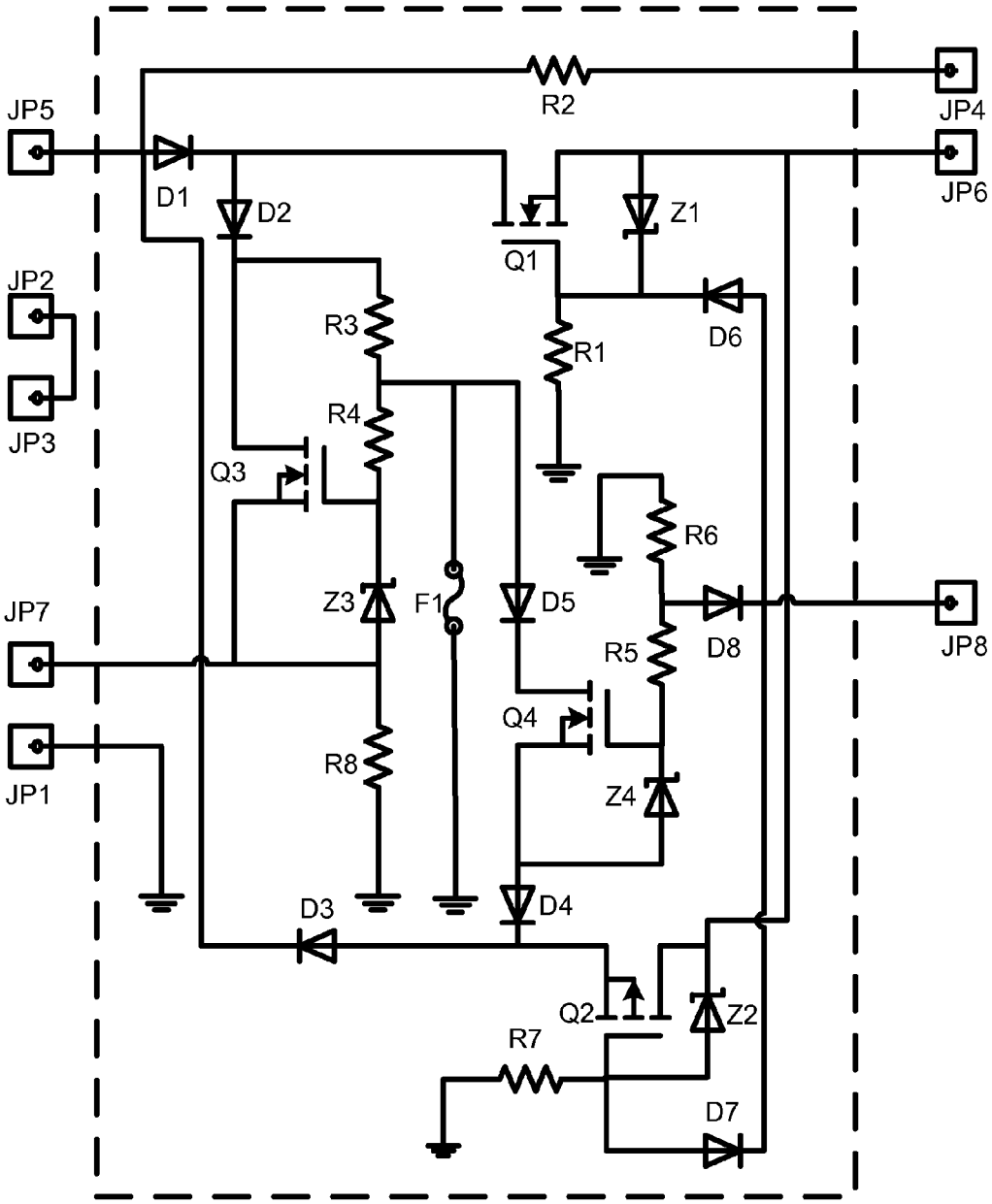
FIGS. 8-12 are schematics.

One embodiment of the ESS, illustrated in FIG. 8, includes the components shown in Table 1. It will be understood by persons of ordinary skill in the art that these components are merely exemplary.

TABLE 1

| Component | Value/Identifier |
|---|---|
| D1-D8 | 1N4007 |
| F1 | 40 mA fuse |
| Q1, Q3, Q4 | IRF840 N-Channel Enhancement Mode MOSFET |
| Q2 | IRF9530 P-Channel Enhancement Mode MOSFET |
| R1 | 750 KΩ |
| R2 | 24 KΩ, 1 watt |
| R3 | 200 KΩ |
| R4 | 200 KΩ |
| R5 | 24 KΩ |
| R6 | 16 MΩ |
| R7 | 16 MΩ |
| R8 | 15 KΩ |
| Z1-Z4 | BZV10 zener diode |

It will be understood that the term "fuse" is used herein in a broad sense to refer to any device which opens an otherwise closed line. The fuse can be an electrical fuse, a low wattage resistor, or other suitable device which opens or is opened (blown).

One embodiment of the ESS can be divided into three sections centered on the MOSFETs. In one embodiment, the first section (or "line switch circuit"), centered on MOSFET Q1, allows positive line currents to pass through from JP5 to JP6 (which correspond to connections 5 and 6 in FIG. 4) to a connected perforating charge element as long as JP4 to JP8 (which correspond to connections 4 and 8 in FIG. 4) are shorted together (using, for example, a wire between JP2 and JP3, which corresponds to connections 2 and 3 in FIG. 4) or otherwise connected. In the same way, MOSFET Q2 allows negative line currents to pass through JP5-JP6 as long as JP4 and JP8 are connected. In one embodiment, the second section (or "arming circuit"), centered on MOSFETs Q2 and Q4, allow the perforating charge element to be armed by application of a negative line power to JP5 when JP4 is no longer connected to JP8. In one embodiment, the third section (or "detonate-enable-switch circuit"), centered on MOSFET Q3 allows the armed perforating charge element to be fired by application of a positive line power. Note that in FIGS. 8-12 two crossing lines are connected unless indicated by a bridge.

In one embodiment, when the perforation apparatus is assembled, it is connected as shown in FIG. 5, perhaps modified as shown in FIG. 7. Further, in this initial state, fuse F1 is intact in all of the perforating charge elements and JP4 is connected to JP8 in all but the first perforating charge element to be fired, which is, in one embodiment, the bottom-most perforating charge element. In FIG. 5, perforating charge element 142 is the bottom-most and, as shown, connection 4 is not connected to connection 8.

Figure 9:
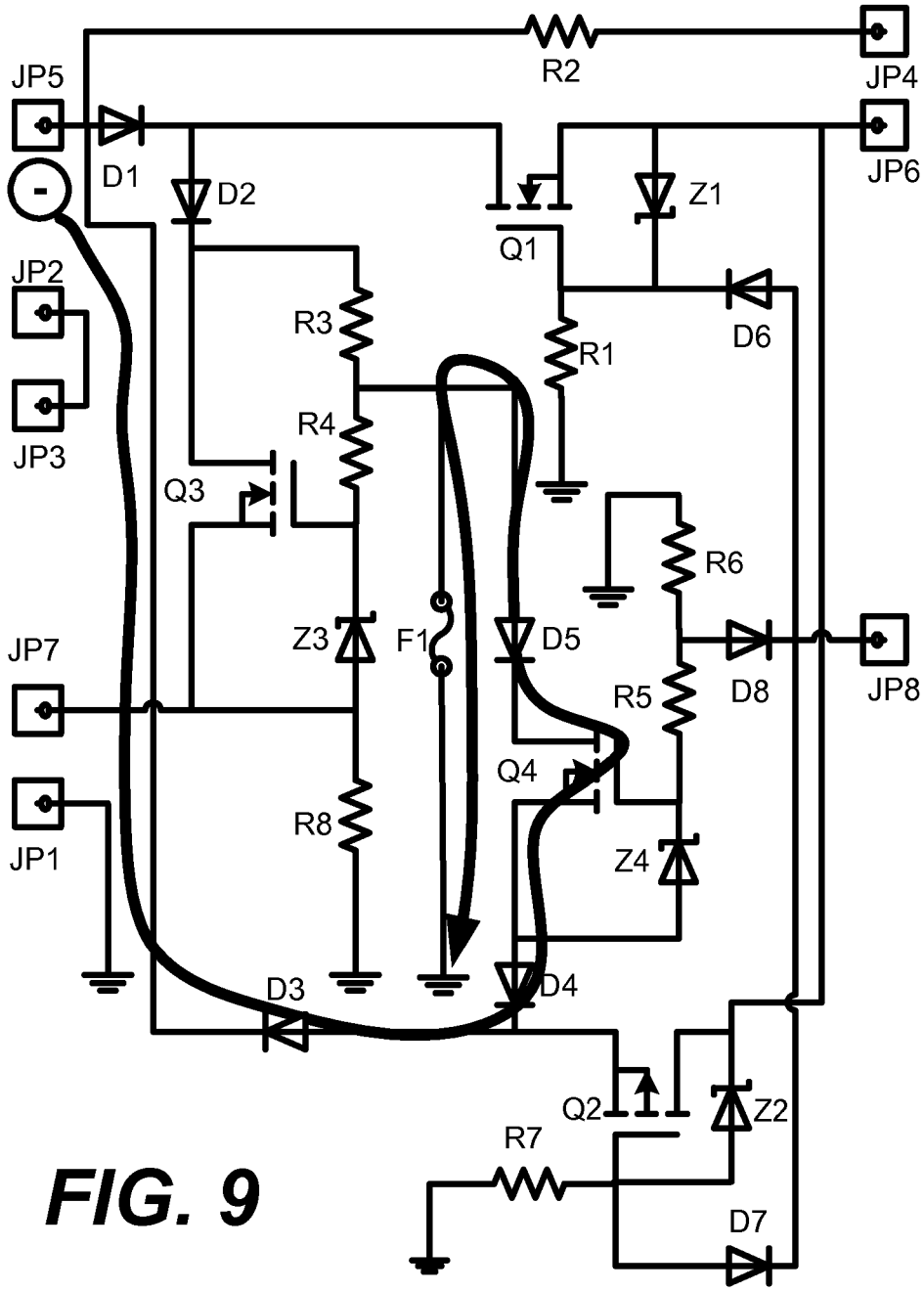

In this state, in one embodiment shown in FIG. 9, the perforating charge element is armed by applying a negative power, typically supplied by the shooting panel 106, to line connector JP5. The negative current cannot flow through R2 because JP4 is not connected to JP8 and is blocked by D1 but it flows through D3 and D4 to Q4, as shown by the heavy curved line. The negative current flow is blocked by Z4, which prevents Q4's gate-to-source voltage from exceeding Q4's specifications. As a result, Q4's gate voltage is at ground through R5 and R6 and is positive relative to Q4's source voltage, which means that Q4 will begin to conduct. The negative current flows through Q4, D5 and F1, causing F1 to blow. Once F1 blows, the current is blocked by Z3 and does not reach the detonator, which is connected between terminals JP7 and JP1 (which correspond to connections 7 and 1 in FIG. 4).

Figure 10:
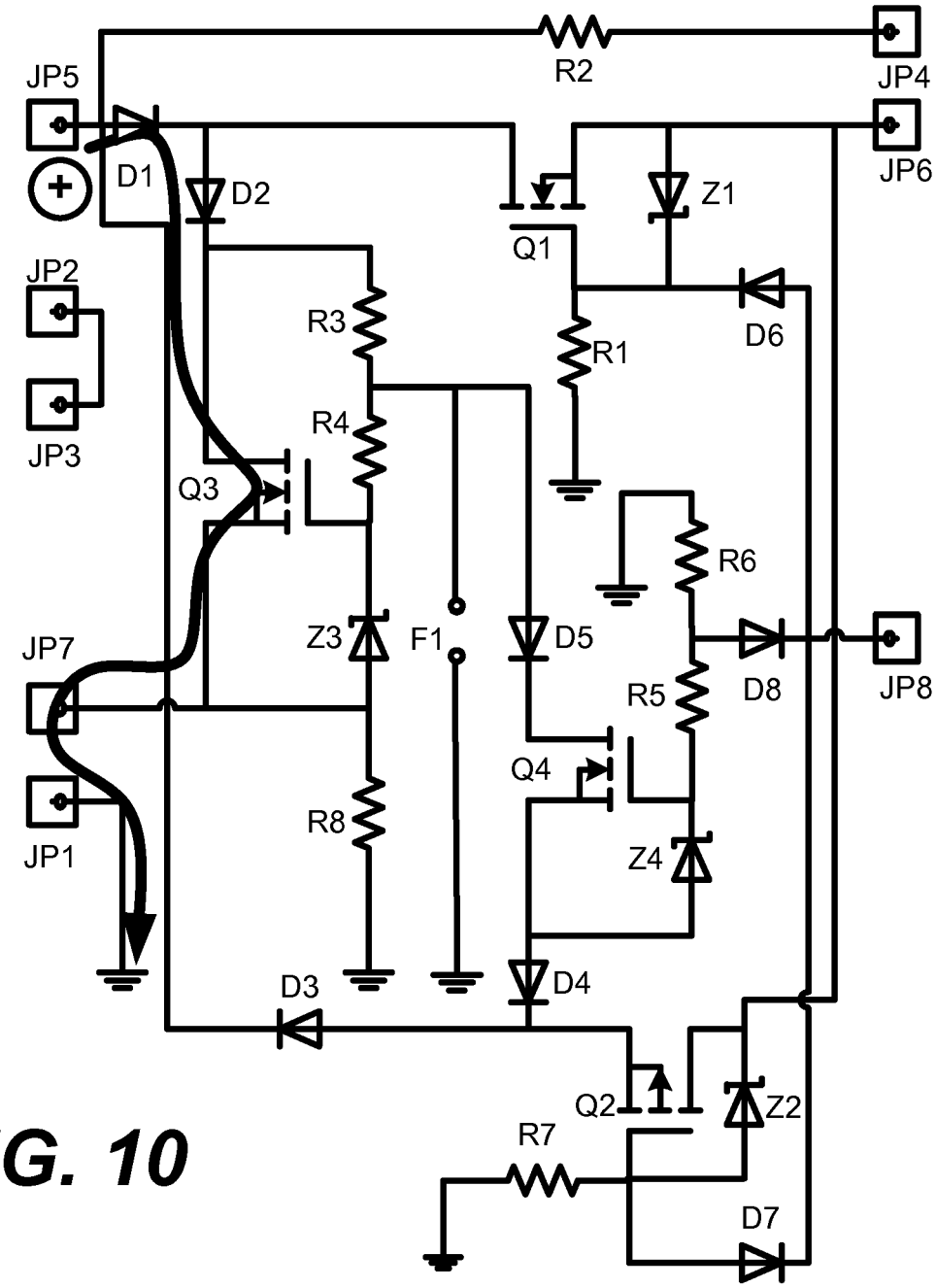

The perforating charge element is now armed, as shown in FIG. 10, because F1 has been blown. In one embodiment, application of a sufficient positive power to JP5 will fire the perforating charge element. In one embodiment, a positive current applied to JP5 will flow, as indicated by the heavy curved line on FIG. 10, through D1 and D2 (note that D2 is provided to prevent a negative current from firing the perforating charge element if Q3 fails) and through R3, R4, Z3 (which is provided to keep the gate-to-source voltage of Q3 within specification) and R8. An operator at the shooting panel 106 can increase the power being applied until the voltage across Z3 and R8 is sufficient to cause Q3 to begin conducting. The positive current will then flow through Q3 and through JP7 to the detonator and back through JP1. When the positive current reaches a sufficient level, the detonator will fire. In one embodiment, firing the detonator will cause the connection from JP2 to JP3 to be destroyed, which will allow the connected perforating charge element to be armed.

Figure 11:
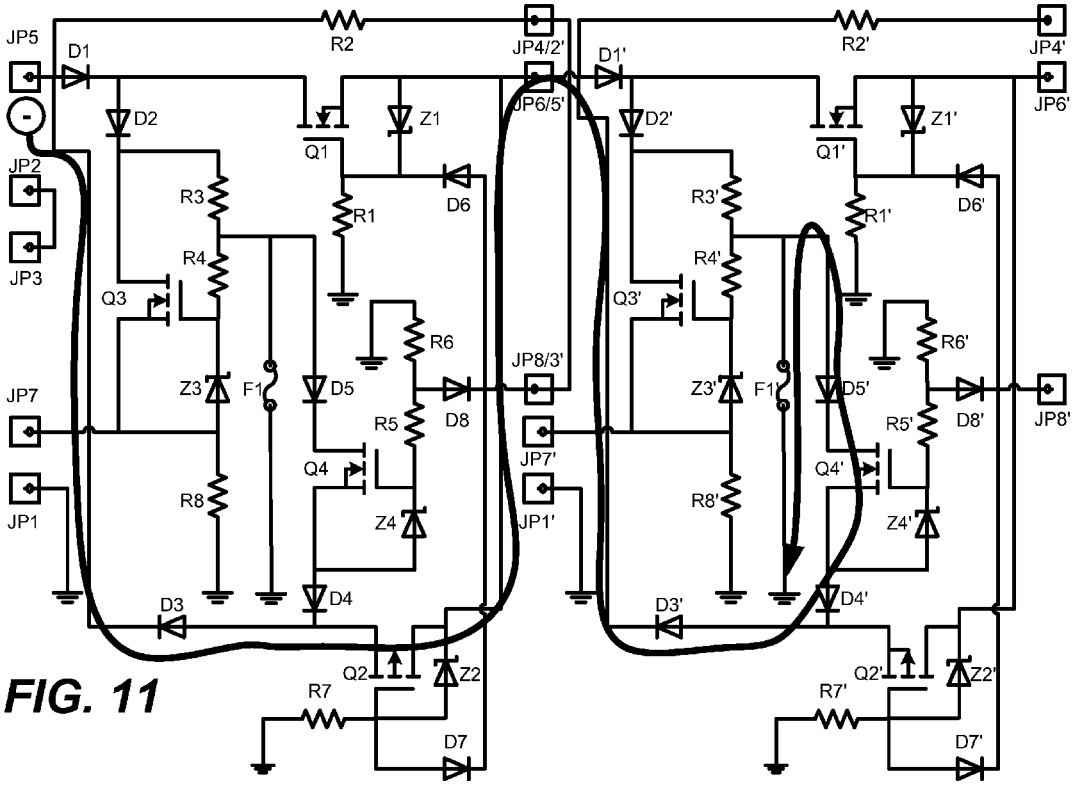

FIG. 11 illustrates the ESS circuits for two connected perforating charge elements (e.g., 138 and 140) after the other perforating charge element (e.g. 142) that was previously connected to one of the perforating charge elements (e.g. 140) has been fired. The "primed" circuit elements (e.g. R1', Q1', etc.) on the right side of FIG. 11 are components in the ESS that is about to be armed and fired. The "unprimed" circuit elements (e.g. R1, Q1, etc.) are components in the ESS one perforating charge element closer to the shooting panel.

The "primed" ESS is armed by application of a negative power to JP5, as indicated by the heavy curved line on FIG. 11. The negative current is blocked by D1 but flows through D3, through R2, through the JP4 to JP2', through the connection from JP2' to JP3' to JP8. The negative current flows through D7 and R7, which creates a voltage drop across R7 and causes Q2 to conduct. The negative current flows through Q2, through JP5 and JP5', and through D3', D4', Q4', and F1' until the negative current is sufficient to blow F1, as discussed above.

Figure 12:
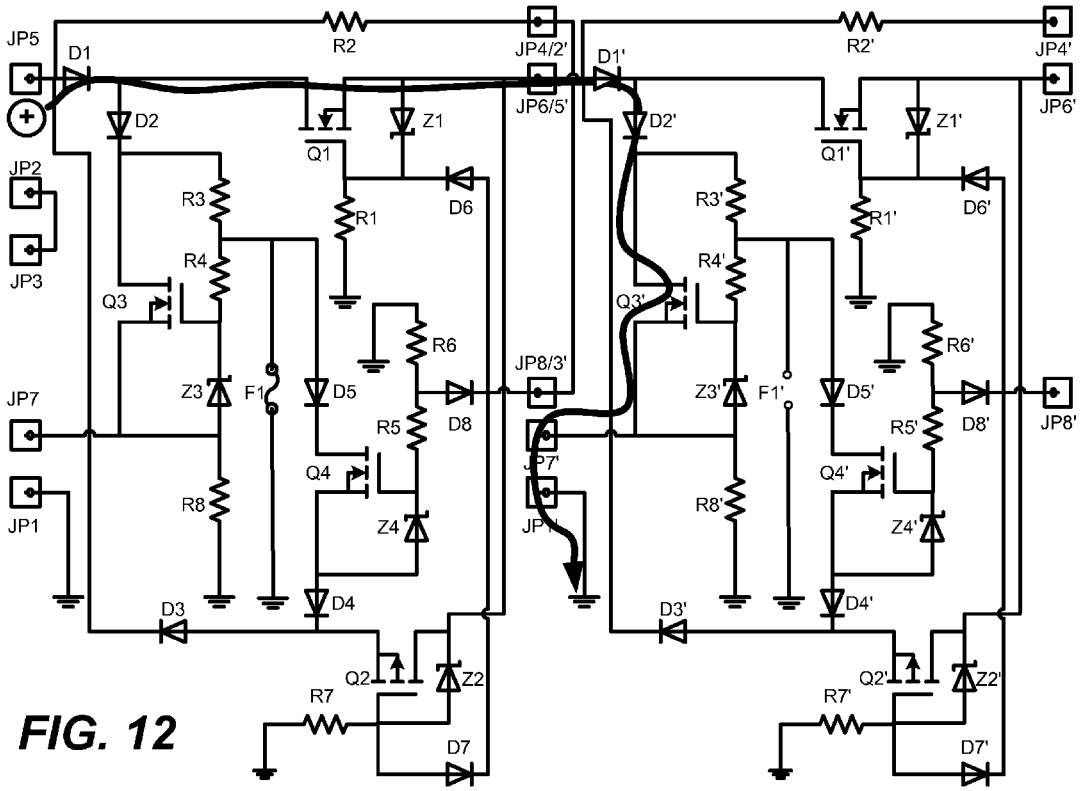

Once F1 is blown, application of a positive power to JP5, as shown in FIG. 12, will fire the detonator in the "primed" perforating charge element. The positive current will flow through JP4, JP2', JP3', JP8, D8, and R1. When the positive current reaches a sufficient level, the voltage drop across R1 will cause Q1 to begin conducting. At that point, the positive current will flow through D1, Q1, JP6, JP5', D1', D2', Q3', JP7', the "primed" detonator, and JP1' to ground, as discussed above in the discussion of FIG. 10. The "primed" detonator will fire when the positive voltage reaches a sufficient level.

It will be understood by persons of ordinary skill in the art that a different arrangement of the same or different components would produce a system in which the arming power is positive and the firing power is negative.

In one embodiment, when the "primed" perforation charge element in FIG. 12 fires, the current shown by the heavy curved line will cease to flow because many or all of the "primed" components will cease to exist. When this happens JP4 and JP8 will either be opened or shorted to ground so that Q1 will stop conducting and the operator at the shooting panel 106 will observe a sharp current reduction on the line. In one embodiment, this reduction in current is a positive indication that the detonator inside the "primed" perforation charge element has fired. However, this is not necessarily an indication that the whole perforation charge element has fired. For example, in one embodiment the same indication (sharp drop in current) would be received if the detonator failed and simply opened the electrical circuit but did not fire the pyrotechnic material.

Further, in one embodiment, the ESS in each perforation charge element has a known voltage drop to a known current applied to the line 515 (see FIG. 5). An operator of the shooting panel 106 or a computer operating the shooting panel 106 can determine the number of unfired perforation charge elements by applying the known current, measuring the voltage across the perforating apparatus 122, if necessary subtracting known voltage drops due to cabling and the like, and dividing by the known ESS voltage drop.

Figure 13:
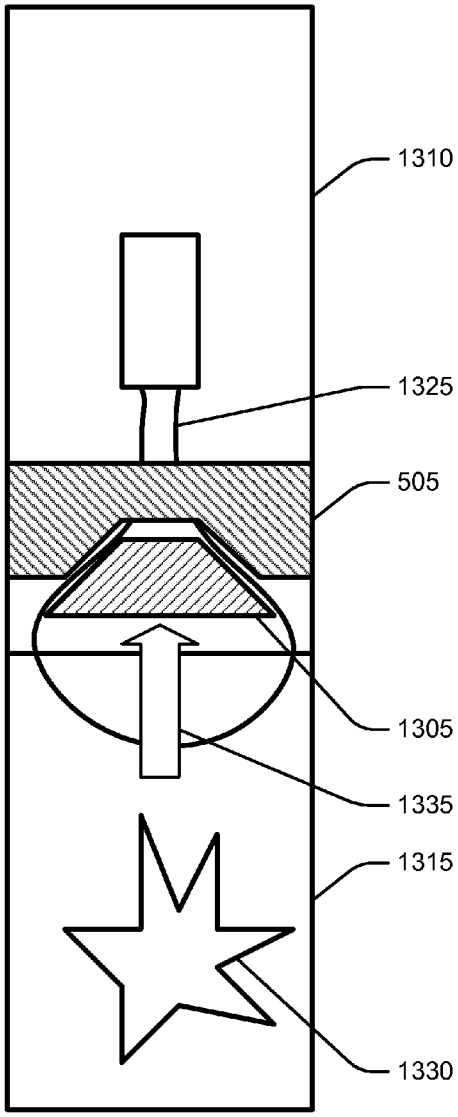
FIGS. 13 and 14 illustrate the operation of an apparatus for removing a connection.
Figure 14:
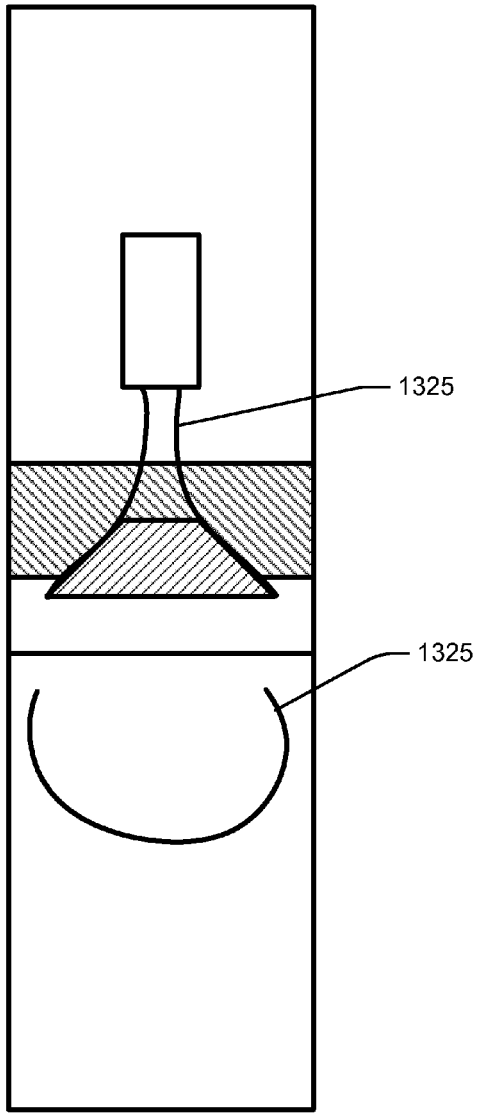

One technique for destroying the connection between JP2 and JP3, i.e., placing a shorting element 520 so that it will be destroyed by the firing of the perforation charge element, is described above in the discussion of FIG. 5. Another approach, shown in one embodiment in FIG. 13, uses a cutting element 1305, located, in one embodiment, in the mechanical coupling 505 between two perforation charge elements. In one embodiment, perforating charge element includes an ESS 1320 with a shorting element 1325 connecting JP4 to JP8. In one embodiment, the shorting element 1325 extends through the mechanical coupling 505, past the cutting element 1305, and into perforating charge element 1315. The cutting element 1305 is loose in the mechanical coupling 505 so that there is a passage for the shorting element. When the perforating charge element 1315 fires, represented by cartoon 1330, a force 1335 is applied to the cutting element 1305. The force 1334 causes the cutting element 1305 to move in a shearing fashion within the mechanical coupling 505, cutting the shoring element 1325, as shown in FIG. 14.

Figure 15:
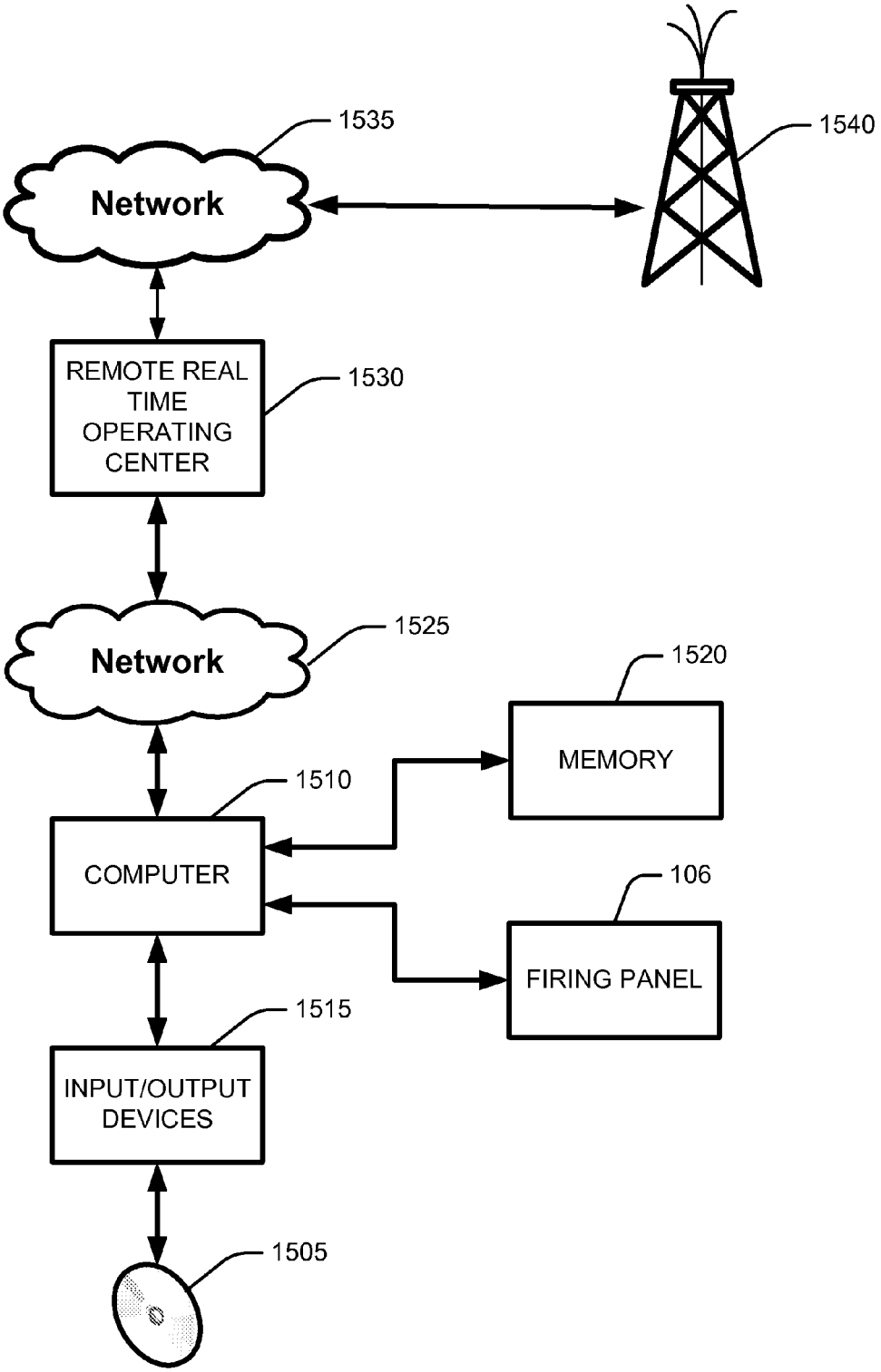
FIG. 15 is a block diagram of a system including a remote real time operating center.

In one embodiment, a status and control function for controlling the shooting panel 106 is stored in the form of a computer program on a computer readable media 1505, such as a CD or DVD, as shown in FIG. 15. In one embodiment a computer 1510, which in one embodiment is coupled to the shooting panel 106, reads the computer program from the computer readable media 1505 through an input/output device 1515 and stores it in a memory 1520 where it is prepared for execution through compiling and linking, if necessary, and then executed. In one embodiment, the system accepts inputs through an input/output device 1515, such as a keyboard, and provides outputs through an input/output device 1515, such as a monitor or printer. In one embodiment, the system stores the results of calculations in memory 1520 or modifies such calculations that already exists in memory 1520.

In one embodiment, the results of calculations that reside in memory 1520 are made available through a network 1525 to a remote real time operating center 1530. In one embodiment, the remote real time operating center makes the results of calculations available through a network 1535 to help in the planning of oil wells 1540 or in the drilling of oil wells 1540. Similarly, in one embodiment, the shooting panel 106 can be controlled from the remote real time operating center 1530.

The word "coupled" herein means a direct connection or an indirect connection.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus comprising:

a circuit comprising:

a line input for receiving a line power;

a line output for transmitting the line power;

a next-gun-detect output;

a next-gun-detect input;

a first detonator connection;

a second detonator connection, the second detonator connection being connected to a ground;

the line input being coupled to the first detonator connection through:

a one-polarity-pass component that only allows power of a first polarity to pass; and a detonate-enable switch circuit that is coupled to the next-gun-detect output and the line input, the detonate-enable switch passing power only if (a) the next-gun-detect output is not coupled to the next-gun-detect input and (b) power of a second polarity has previously been applied to the line input while the next-gun-detect output is not coupled to the next-gun-detect input.

2. The apparatus of claim 1 wherein the circuit further comprises:

a arming circuit that:

disables the detonate-enable switch component from passing power if the next-gun-detect output is coupled to the next-gun-detect input;

enables the detonate-enable switch component to pass power if the next-gun-detect output is not coupled to the next-gun-detect input.

3. The apparatus of claim 1 wherein the circuit further comprises:

a line switch circuit that allows power of the first polarity to pass only if the next-gun-detect output is not coupled to the next-gun-detect input.

4. The apparatus of claim 1 wherein the first polarity is a positive polarity relative to ground and the second polarity is a negative polarity relative to ground.

5. The apparatus of claim 1 further comprising:

a fail-safe one-polarity-pass component coupled to the detonate-enable switch circuit that prevents power of the second polarity from flowing to the detonate-enable circuit.

6. A method comprising:

coupling a plurality of perforating guns to a shooting panel, the plurality of perforating guns being numbered P1 to Pn, with P1 being the lowest perforating gun, P2 being the perforating gun immediately above P1 and so on up to Pn being the perforating gun immediately above Pn−1;

applying a power of a first polarity to the string of perforating guns to arm Pm, a lowest gun that has not yet been fired;

applying a power of a second polarity to the string of perforating guns to fire Pm;

after firing Pm, applying a power of the first polarity to the string of perforating guns to arm Pm+1; and applying a power of the second polarity to the string of perforating guns to fire Pm+1.

7. The method of claim 6 further comprising:

applying a constant current of the first polarity from a constant current device before firing a first perforating gun and after firing the first perforating gun;

confirming the firing of the first perforating gun by observing a smaller voltage being applied by the constant current device after firing the first perforating gun that before firing the first perforating gun.

8. The method of claim 6 further comprising:

applying a constant current of the first polarity from a constant current device to the string of perforating guns;

determining from a voltage being applied by the constant current device the number of perforating guns that have not yet been fired.

9. A method comprising:

coupling a plurality of perforating guns to a shooting panel;

applying a constant current from a constant current device to the string of perforating guns;

determining from a voltage being applied by the constant current device the number of perforating guns that have not yet been fired, wherein determining comprises:

subtracting from the voltage a voltage drop associated with equipment in a perforating system that includes the perforating guns to produce a result voltage; and dividing the result voltage by a voltage drop per perforating gun to produce the number of perforating guns that have not yet been fired.

10. A perforating system for perforating a well, the perforating system including a plurality of perforating guns suspended in the well from one of a wireline and a coiled tubing, at least one of the perforating guns comprising:

a circuit comprising:

a line input for receiving a line power;

a line output for transmitting the line power;

a next-gun-detect output;

a next-gun-detect input;

a first detonator connection;

a second detonator connection, the second detonator connection being connected to a ground;

the line input being coupled to the first detonator connection through:

a one-polarity-pass component that only allows power of a first polarity to pass; and a detonate-enable switch component that is coupled to the next-gun-detect output and the line input, the detonate-enable switch passing power only if (a) the next-gun-detect output is not coupled to the next-gun-detect input and (b) power of a second polarity has previously been applied to the line input while the next-gun-detect output is not coupled to the next-gun-detect input;

a detonator coupled to the first detonator connection and the second detonator connection of the circuit;

a line input wire coupled to a line input connector on the perforating gun and the line input of the circuit;

a line output wire coupled to a line output of the circuit and a line output connector on the perforating gun;

an other-gun loop coupled between a other-gun-loop input connector and a other-gun-loop output connector on the perforating gun, the loop being placed so that it will be destroyed when the gun is fired;

a this-gun loop coupled between the next-gun-detect input and the next-gun-detect output of the circuit.

11. The perforating system of claim 10 wherein the this-gun loop comprises:

a wire between the next-gun-detect input of the circuit and a next-gun-detect input of the perforating gun; and a wire between the next-gun-detect output of the circuit and a next-gun-detect output of the perforating gun.

12. The perforating system of claim 10 wherein the this-gun loop comprises:

a wire coupled to the next-gun-detect input and the next-gun-detect output of the circuit; and the wire passing into a next gun in such a way that when the next gun fires the wire will no longer conduct.

13. The perforating system of claim 10 further comprising:

a coupler between the at least one perforating gun and a second perforating gun;

the coupler including a moveable member, the moveable member being positioned so that when the second perforating gun fires, the moveable member severs the this-gun loop.

14. The perforating system of claim 10 wherein the circuit further comprises:

an arming circuit that:

disables the detonate-enable switch component from passing power if the next-gun-detect output is coupled to the next-gun-detect input;

enables the detonate-enable switch component to pass power if the next-gun-detect output is not coupled to the next-gun-detect input.

15. The perforating system of claim 10 wherein the circuit further comprises:

a line switch circuit that allows power of the first polarity to pass only if the next-gun-detect output is not coupled to the next-gun-detect input.

16. The perforating system of claim 10 wherein the first polarity is a positive polarity relative to ground and the second polarity is a negative polarity relative to ground.

17. The perforating system of claim 10 further comprising:

a fail-safe one-polarity-pass component coupled to the detonate-enable switch circuit that prevents power of the second polarity from flowing to the detonate-enable circuit.

18. The perforating system of claim 10 further comprising:

a shooting panel coupled to the circuit and providing the line power, the shooting panel controlling the amount and polarity of the line power.

19. The perforating system of claim 10 further comprising:

a network;

a computer coupled to and controlling the shooting panel; and a remote real time operating center coupled to the computer through the network, the remote real time operating center controlling the shooting panel through the computer.

* * * * *